US010342371B2

(12) United States Patent
Shieh

(10) Patent No.: US 10,342,371 B2
(45) Date of Patent: Jul. 9, 2019

(54) BOTTLE COVER AND BOTTLE WITH THE BOTTLE COVER

(71) Applicant: LIFE & LIVING INTERNATIONAL LIMITED, Hong Kong (CN)

(72) Inventor: Jaw-Chyi Shieh, Hong Kong (CN)

(73) Assignee: LIFE & LIVING INTERNATIONAL LIMITED, Kowloon Bay (HK)

( * ) Notice: Subject to any disclaimer, the term of this patent is extended or adjusted under 35 U.S.C. 154(b) by 388 days.

(21) Appl. No.: 15/093,542

(22) Filed: Apr. 7, 2016

(65) Prior Publication Data

US 2017/0181558 A1 Jun. 29, 2017

(30) Foreign Application Priority Data

Dec. 24, 2015 (TW) ..... 104220744 U

(51) Int. Cl.

| | |
|---|---|
| ***B65D 51/16*** | (2006.01) |
| ***A47G 23/02*** | (2006.01) |
| ***B65D 23/08*** | (2006.01) |
| ***B65D 81/20*** | (2006.01) |

(52) U.S. Cl.

CPC ..... *A47G 23/0241* (2013.01); *B65D 23/0885* (2013.01); *B65D 81/2038* (2013.01)

(58) Field of Classification Search

CPC ..... A47G 23/0241; A47J 47/06; A47J 47/10; B65D 81/2038; B65D 81/20; B65D 23/0885

USPC .... 220/202, 367.1, 737, 203.04, 212.5, 378, 220/231, 203.07; 215/260, 262, 270

See application file for complete search history.

(56) References Cited

U.S. PATENT DOCUMENTS 5,651,470 A * 7/1997 Wu ..... F16J 13/24 141/65

* cited by examiner

*Primary Examiner* — Fenn C Mathew
*Assistant Examiner* — Elizabeth J Volz
(74) *Attorney, Agent, or Firm* — Muncy, Geissler, Olds & Lowe, P.C.

(57) ABSTRACT

A bottle cover is provided, which includes a bottom member, a sleeve, a top member, a hollow base, an elastic component, and a first sealing component. The sleeve is movably sleeved with the bottom member. The top member is disposed at the top portion of the sleeve. The hollow base is separately combined with the bottom member, and has a first hole and a second hole. The elastic component has one end sleeved with the hollow base, and the other end sleeved with the sleeve. The first sealing component includes a first buckle component detachably penetrating and buckled with the first hole, and a first cover component separately covering the second hole. A bottle to be coupled with the bottole cover is also provided.

13 Claims, 5 Drawing Sheets

BOTTLE COVER AND BOTTLE WITH THE BOTTLE COVER

CROSS-REFERENCE TO RELATED APPLICATION

The present application is based on, and claims priority from Taiwan Application Number 104220744, filed Dec. 24, 2015, the disclosure of which is hereby incorporated by reference herein in its entirety.

BACKGROUND

1. Technical Field

The disclosure relates to bottle covers and bottles which are suitable for the bottle covers, and, in particular, to a bottle cover having a structure that can evacuate the air from a bottle and a bottle with the bottle cover.

2. Description of Related Art

In the modern society, the proportion of eating out is much higher than before. Besides, buying launch directly from restaurants or convenient stores and bringing bento are gradually becoming a new trend, because the foods are more fresh and hygienic. Therefore, it is important to choose a food container with a good quality.

There are many types of sealing containers for storing fruit or meals. Some of the containers even have a special design, e.g., a pumping function, to extract the air to a region outside of the container. However, such pumping function is rarely used in the containers for storing beverage, such as juice, soup or tea.

Therefore, how to design a bottle cover with a pumping mechanism is currently the problem that needs to be solved.

SUMMARY

In order to solve the problems encountered in the traditional technology, the present disclosure is to provide a bottle cover, which includes a bottom member; a sleeve that movably sleeved with the bottom member; a top member disposed at the top portion of the sleeve; a hollow base detachably combined with the bottom member and having a first hole and a second hole; an elastic component having one end sleeved with the hollow base and the other end sleeved with the sleeve; and a first sealing component having a first buckle component that detachably penetrates and is buckled with the first hole, and a first cover component that separately covers the second hole.

In an embodiment according to the present disclosure, the bottom member includes a first base having a first opening disposed at the center thereof; a first side wall vertically and circularly formed on the exterior margin of the first base; a first hollow protruding component disposed above and being in communication with the first opening, and having a second opening and a first stop portion at a top portion thereof; and a second side wall circularly formed under the first opening and having a first convex component on an outer side thereof.

In an embodiment, the sleeve includes a second stop portion and a third opening corresponding to the first hollow protruding component, and is movably sleeved on the first hollow protruding component and bears against the first stop portion by the second stop portion. The hollow base includes a second base having a fourth opening at the center thereof. A third side wall is vertically and circularly disposed on the second base, and has a second convex component corresponding to the first convex component on the inner side thereof. A second hollow protruding component is disposed above and in communication with the fourth opening. The hollow base and the bottom member may be separately combined together by the second convex component combined with the first convex component. A third hollow protruding component is disposed above and connected with the second hollow protruding component. The first hole and the second hole are disposed at the top portion of the third hollow protruding component. The elastic component has one end sleeved with the third hollow protruding component, and the other end sleeved with the sleeve.

In an embodiment according to the present disclosure, the top member has a third convex component and a fourth convex component on the inner side thereof. The sleeve has a first concave component corresponding to the fourth convex component at the top portion thereof. The third convex component is sleeved on a periphery of the top portion of the sleeve. The fourth convex component is engaged with the first concave component.

In an embodiment according to the present disclosure, the bottle cover further includes a locking component, the fourth convex component has a locking hole, the first concave component has a through-hole, and the locking component is used for passing through the through-hole and being fixed in the locking hole.

In an embodiment according to the present disclosure, the bottle cover further includes a second sealing component, the sleeve further includes a third stop portion, and the second sealing component is disposed between the second stop portion and the third stop portion.

In an embodiment according to the present disclosure, the sleeve further includes a fourth stop portion, and the first stop portion further includes a recess corresponding to the fourth stop portion.

In an embodiment according to the present disclosure, the bottle cover further includes a third sealing component disposed among the second base, the third side wall and a lateral wall of the second hollow protruding component.

In an embodiment according to the present disclosure, the bottle cover further includes a fourth sealing component having a fourth buckle component and a fourth cover component, the first base further includes a third hole, the fourth buckle component is detachably penetrating and buckled with the third hole, and the fourth cover component is separately covering the third hole.

In an embodiment according to the present disclosure, the bottom member further has a fifth convex component on the outer side thereof, and the top member further has a sixth convex component on the outer side thereof.

The present disclosure is also to provide a bottle having the bottle cover described above, the bottom member further has a seventh convex component on the inner side of the first side wall thereof, the bottle further has a bottle body that has an opening and an eighth convex component corresponding to the seventh convex component nearing the exterior margin of the opening, and the bottle cover is separately combined with the eighth convex component through the seventh convex component.

In an embodiment according to the present disclosure, the bottle further includes a fifth sealing component, the bottom member further includes a ninth convex component corresponding to the shape of the opening and circularly disposed between the first side wall and the second side wall, and the fifth sealing component is disposed between the first side wall and the ninth convex component and is configured to bear against the opening.

In an embodiment according to the present disclosure, the bottle further includes a protective sleeve sleeved with the bottle body and is made of a cushion material.

Compared to the prior art, the bottle cover provided according to the present disclosure has the ability to evacuate the air from the bottle, such that the bottle cover can be tightly putted on the bottle, and the air inside the bottle also can be drawn out. Therefore, prolong the freshness of the beverage contained in the bottle and prevent the deterioration effectively.

DETAILED DESCRIPTIONS

The following specific examples illustrate the implementation of the present disclosure. It will be appreciated by one skilled in the art that variations of these specific details are possible while still achieving the results of the present disclosure.

As would be appreciated by an ordinarily skilled artisan, the structure, proportion, and size of the drawings are only used to fit the contents revealed by the specification for understanding and reading for people who are familiar with this skill, is not used to limit the conditions in which the present disclosure can be implemented. Therefore, it does not have the substantive meaning of technology. The modification of any structure, the change of the proportional relationship or the adjustment of the size, should be covered by the technical content disclosed in this disclosure under the influence of the effect of the creation and the purpose that can be achieved. Meanwhile, the statement quoted as "above", "inside", "outside", "bottom" and "one" etc., are only for the convenience of the narrative, not to limit the scope of this disclosure, the change or adjustment of its relative relationship, also considered as the scope of the implementation of this disclosure without the substantial change in the content of the technology, and declared in advance.

Figure 1:
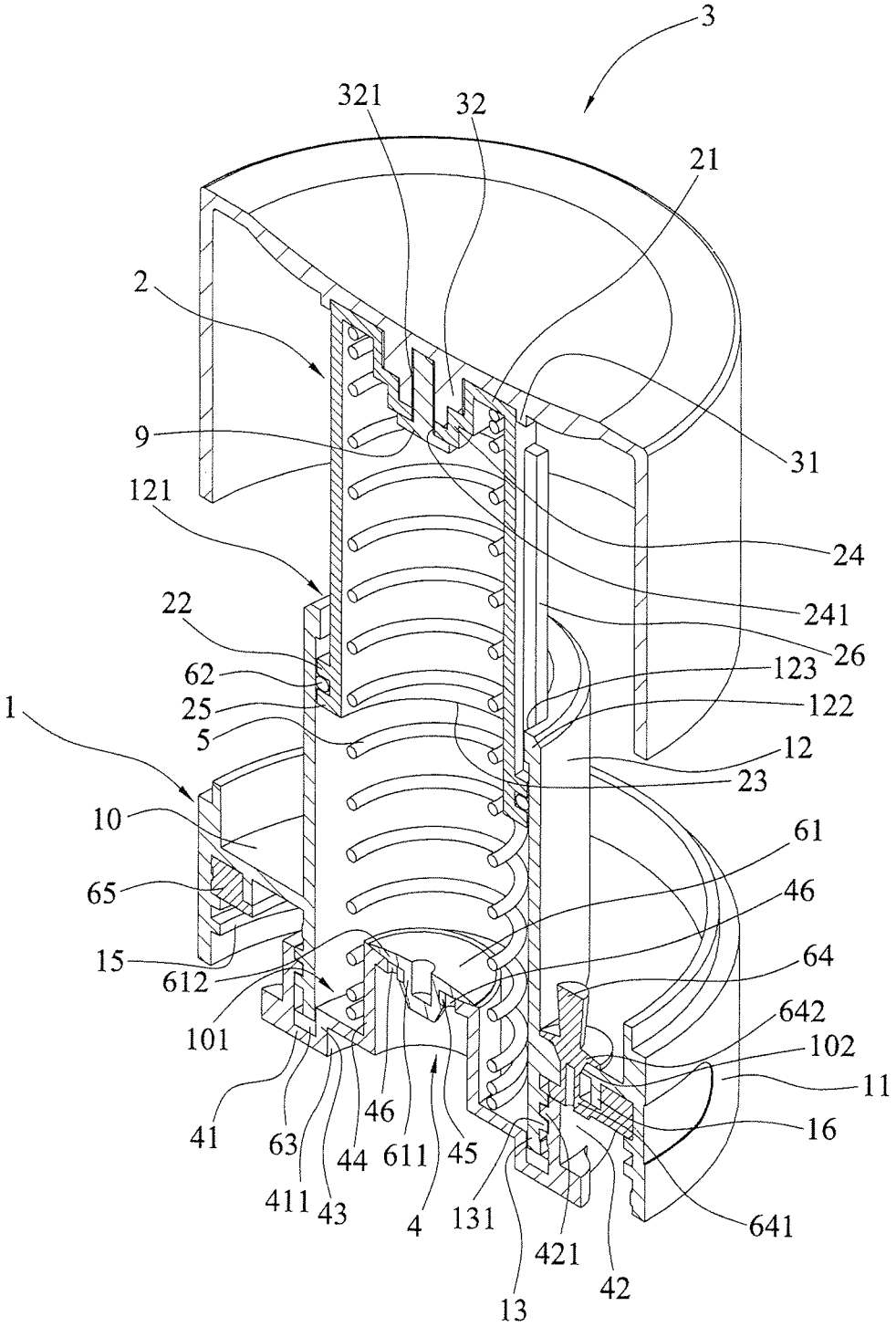
FIG. 1 is a sectional view of a bottle cover according to the present disclosure.

Please refer to FIG. 1, which is a sectional view of a bottle cover according to the present disclosure. The bottle cover mainly includes a bottom member 1, a sleeve 2, a top member 3, a hollow base 4, an elastic component 5, and a first sealing component 61. The sleeve 2 is movably sleeved with the bottom member 1. The top member 3 is disposed at the top portion 21 of the sleeve 2. The hollow base 4 has a first hole 45 and a second hole 46, and is separately combined with the bottom member 1. A user can remove the hollow base 4 from the bottom member 1. The elastic component 5 has one end sleeved with the hollow base 4, and the other end sleeved with the sleeve 2. A user can move the sleeve 2 toward the hollow base 4 by pressing the top member 3, and the elastic component 5 will be squeezed and compressed.

The first sealing component 61 includes a first buckle component 611 and a first cover component 612. As shown in FIG. 1, the first buckle component 611 and the first cover component 612 are approximately in the shape of a thumbtack. When the first buckle component 611 detachably penetrates the first hole 45, the first cover component 612 will cover the second hole 46. The main function of the second hole 46 is for air flow. The first cover component 612 is separated from the second hole 46 at least partially while the air passes through the second hole 46.

In an embodiment according to the present disclosure, the bottom member 1 includes a first base 10, a first side wall 11, a first hollow protruding component 12, and a second side wall 13. Please refer to FIG. 1. The first base 10 has a first opening 101 at the center thereof. The first side wall 11 is vertically and circularly disposed on the exterior margin of the first base 10. The first hollow protruding component 12 is disposed above and in communication with the first opening 101, and has a second opening 121 and a first stop portion 122 at the top portion thereof. The second side wall 13 is circularly disposed under the first opening 101 and in communication with the first opening 101 and the first hollow protruding component 12, and the second side wall 13 has a first convex component 131 on the outer side thereof.

Figure 2:
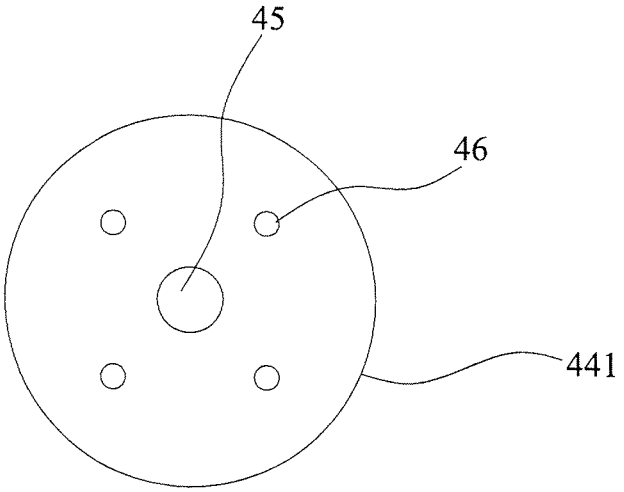
FIG. 2 is a top view of a top portion of a third hollow protruding component of the bottle cover according to the present disclosure.

In an embodiment, the sleeve 2 includes a second stop portion 22 corresponding to the first stop portion 122, and a third opening 23 corresponding to the first hollow protruding component 12. The sleeve 2 is movably sleeved on the first hollow protruding component 12, and bears against the first stop portion 122 through the second stop portion 22, to prevent the sleeve 2 from falling off from the first hollow protruding component 12 while moving. The hollow base 4 includes a second base 41, a third side wall 42, a second hollow protruding component 43, and a third hollow protruding component 44. The second base 41 has a fourth opening 411 at the center thereof. The third side wall 42 is vertically and circularly disposed on the second base 41. As shown in FIG. 1, the second hollow protruding component 43 is disposed above and in communication with the fourth opening 411. The third side wall 42 has a second convex component 421 corresponding to the first convex component 131 on the inner side thereof. In an embodiment, the second convex component 421 and the first convex component 131 may each include a screw thread corresponding to each other, such that the hollow base 4 and the bottom member 1 can be combined together or separated from each other in a rotating manner. The third hollow protruding component 44 is disposed above the second hollow protruding component 43, the third hollow protruding component 44 is in communication with the second hollow protruding component 43, and the first hole 45 and the second hole 46 are disposed at the top portion 441 of the third hollow protruding component 44. Referring to FIG. 2, a top view of the top portion of the third hollow protruding component 44 according to the present disclosure is illustrated. The second hole 46 is distributed around the first hole 45, in order to allow the first cover component 612 to cover the second hole 46 evenly when the first sealing component 61 is disposed on the second hole 46 by the first buckle component 611.

In an embodiment according to the present disclosure, the top member 3 has a third convex component 31 and a fourth convex component 32 on the inner side thereof, the sleeve 2 has a first concave component 24 corresponding to the fourth convex component 32 at the top portion 21 thereof. The third convex component 31 is sleeved on a periphery of the top portion 21 of the sleeve 2. The fourth convex component 32 is engaged with the first concave component 24, which allows the top portion 21 of the sleeve 2 to bear against the top member 3, and limits or fixes the position of the sleeve 2 by the third convex component 31 and the fourth convex component 32. While one end of the elastic component 5 is sleeved with the third hollow protruding component 44, the other end will extend into the sleeve 2 and be sleeved with the first concave component 24, such that the elastic component 5 will not be distorted due to the uneven stress while being compressed.

In an embodiment according to the present disclosure, a locking component 9 is further included, the fourth convex component 32 has a locking hole 321, the first concave component 24 has a through-hole 241, the locking component 9 is configured to penetrate the through-hole 241 and fix in the locking hole 321, and the sleeve 2 may be assembled with the top member 3 to form an assembly.

In an embodiment according to the present disclosure, a second sealing component 62 is further included, and the sleeve 2 further includes a third stop portion 25. As shown in FIG. 1, the second sealing component 62 is disposed between the second stop portion 22 and the third stop portion 25, and the second sealing component 62 prevents the air from leaking into the bottle through the gap between the sleeve 2 and the bottom member 1 to ensure that the air is not likely to leak into the bottle after pumping.

In an embodiment, the sleeve 2 further includes a fourth stop portion 26, and the first stop portion 122 further includes a recess 123 corresponding to the fourth stop portion 26. As shown in FIG. 1, in an embodiment the fourth stop portion 26 is a strip-shaped convex component and disposed in the recess 123, and the reciprocating movement of the sleeve 2 is more firmly through the fourth stop portion 26 buckled with the recess 123, to prevent the improper displacement caused by the unnecessary external forces. When a user presses the top member 3 which causes the sleeve 2 moves downwards, the fourth stop portion 26 entirely passes through the recess 123, and the user can thus rotate the upper over 3 and the sleeve 2 to allow the fourth stop portion 26 to bear against the first stop portion 122 to maintain the top member 3 and the sleeve 2 in a compressed configuration.

Figure 3:
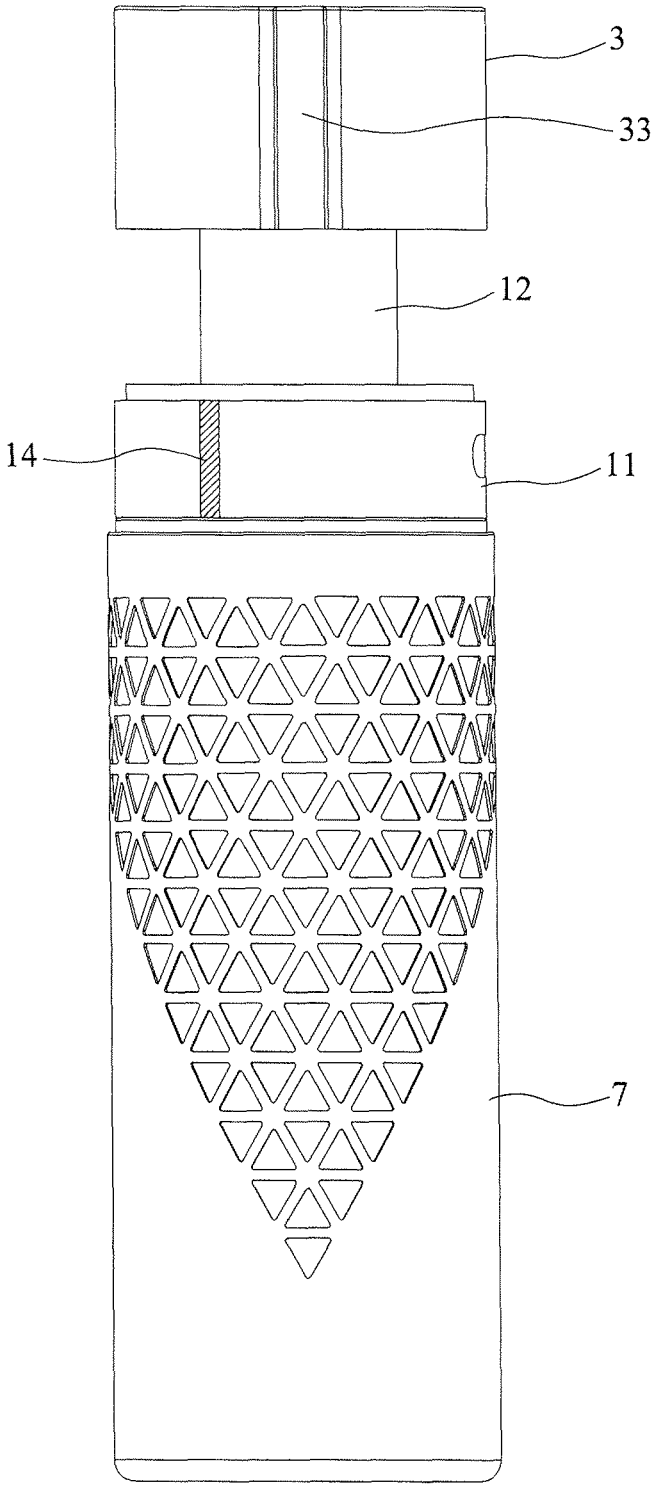
FIG. 3 is a schematic diagram of a bottle according to a first embodiment of the present disclosure.
Figure 4:
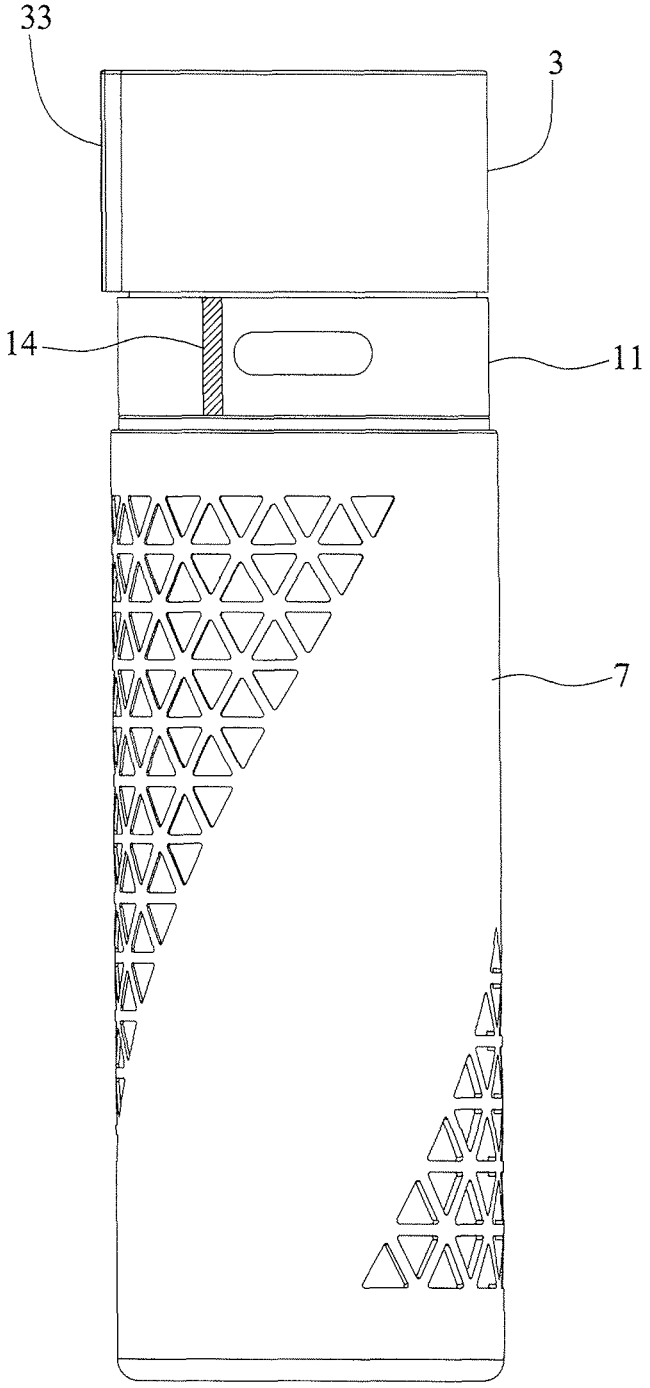
FIG. 4 is a schematic diagram of a bottle according to a second embodiment of the present disclosure.

Please refer to FIGS. 3 and 4. FIG. 3 is a schematic diagram of the bottle according to a first embodiment of the present disclosure. FIG. 4 is a schematic diagram of the bottle according to a second embodiment of the present disclosure. The bottle cover shown in FIG. 3 is in a compression state, with the fourth stop portion 26 bearing against the first stop portion 122. The bottle cover shown in FIG. 4 is in an uncompressed state, with the fourth stop portion 26 disposed in the recess 123.

In an embodiment according to the present disclosure, a third sealing component 63 is further included and disposed among the second base 41, the third side wall 42 and a lateral wall of the second hollow protruding component 43. Compared with the second sealing component 62 that is configured to prevent the air from leaking through the gap between the sleeve 2 and the bottom member 1, the third sealing component 63 is configured to avoid the air from leaking through the gap between the bottom member 1 and the hollow base 4, such that the air is not likely to leak after pumping.

In an embodiment according to the present disclosure, a fourth sealing component 64 having a fourth buckle component 641 and a fourth cover component 642 is further included. The first base 10 further includes a third hole 102. The fourth buckle component 641 is detachably penetrating and buckled with the third hole 102. The fourth cover component 642 is separately covering the third hole 102. This is because after evacuating the air from the bottle by using the pumping function of the bottle cover, the pressure outside the bottle is greater than that inside the bottle, which makes the combination of the bottle cover and the bottle is very tight, so it may be difficult to open the bottle cover smoothly for the weakness. Under this circumstance, the pressure that outside and inside the bottle could reach a balance by adjusting the four sealing component 64, and a user can easily open the bottle cover. Besides, the bottom member 1 has a fifth convex component 14 on the outer side thereof and the top member 3 has a sixth convex component 33 on the outer side thereof, in order to facilitate the implementation of pumping air, rotating the bottle cover and other operations by applying little force by a user while holding the bottle.

Figure 5:
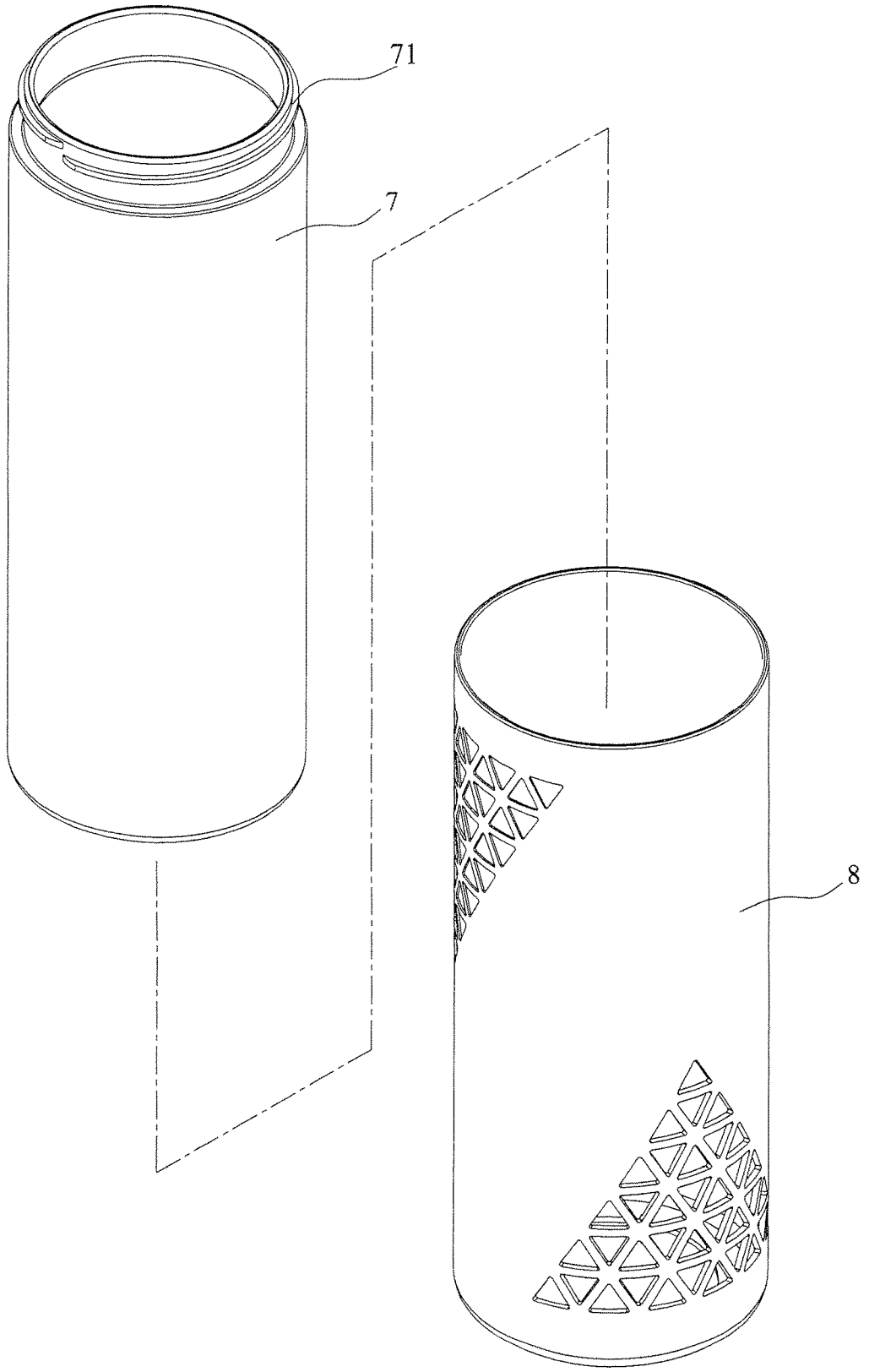
FIG. 5 is a schematic diagram of a bottle body according to the present disclosure.

Please refer to FIGS. 1 and 5. FIG. 5 is a schematic diagram of the bottle body according to the present disclosure. The present disclosure further provides a bottle. In addition to the aforementioned bottle cover comprised with the bottom member 1, the sleeve 2, the top member 3, the hollow base 4, the elastic component 5, the first sealing component 61 and/or the assemblies disclosed by other embodiments, the bottle further includes a bottle body 7. The first side wall 11 of the bottom member 1 has a seventh convex component 15 on the inner side thereof. The bottle body 7 has an eighth convex component 71 corresponding to the seventh convex component 15 on an exterior margin of an opening thereof. The seventh convex component 15 and the eighth convex component 71 may each include a screw thread structure corresponding to each other, in order to make the bottom member 1 and the bottle body 7 to be combined together or separated from each other in a rotating manner.

As shown in FIG. 1, in an embodiment according to the present disclosure the bottle further includes a fifth sealing component 65, the bottom member 1 further includes a ninth convex component 16 corresponding to the shape of the opening of the bottle body 7 and is circularly disposed between the first side wall 11 and the second side wall 13, and the fifth sealing component 65 is disposed between the first side wall 11 and the ninth convex component 16. While a user is getting the bottle cover on the opening of the bottle body 7, the bottle may keep in a closed state through the fifth sealing component 65 bearing against the opening, and the air is difficult to be discharged or inflowed. Besides, the bottle body 7 further includes a protective sleeve 8. In an embodiment, the protective sleeve 8 is made of a cushion material, and the bottle body 7 is sleeved with protective sleeve 8 to avoid the bottle body 7 from being damaged by falling or collision.

In summary, the present disclosure mainly provides a bottle cover having a pumping structure, which includes the bottom member, the sleeve, the top member, the hollow base, the elastic component, the first sealing component and/or the assemblies disclosed by other embodiments. A user could make the sleeve move down by pressing the top member. With the compression of the elastic component, the air inside the closed space within the sleeve could be made to generate a pressure forcing to the first sealing component. While the first sealing component is under pressure, the air inside the bottle will be discharged from the second hole. Repeating this operation to evacuate the air from the bottle makes the pressure inside of the bottle to reach a negative pressure relative to that outside of the bottle, in order to keep the juice and other beverages in the bottle to achieve a better storage quality. Besides, the bottle cover and the bottle according to the present disclosure have a simple structure, so as to facilitate the operation by a user, and the effect of pumping air and keeping negative pressure is more significant.

While the present disclosure has been particularly shown and described with reference to a preferred embodiment, it will be understood by those skilled in the art that various changes in form and detail may be without departing from the spirit and scope of the present disclosure.

What is claimed is:

1. A bottle cover, comprising:

a bottom member;

a sleeve movably sleeved with the bottom member;

a top member disposed at a top portion of the sleeve;

a hollow base separately combined with the bottom member and having a first hole and a second hole;

an elastic component having one end sleeved with the hollow base and the other end sleeved with the sleeve;

a first sealing component having a first buckle component detachably penetrating and buckled with the first hole and a first cover component separately covering the second hole; and wherein the bottom member includes:

a first base having a first opening at a center thereof;

a first side wall vertically and circularly formed on an exterior margin of the first base;

a first hollow protruding component disposed above and in communication with the first opening and having a second opening and a first stop portion at a top portion thereof; and a second side wall circularly formed under the first opening, and having a first convex component on an outside thereof;

wherein the sleeve is movably sleeved with the first hollow protruding component, and includes a second stop portion configured to bear against the first stop portion and a third opening corresponding to the first hollow protruding component;

wherein the hollow base includes:

a second base having a fourth opening at a center thereof;

a third side wall vertically and circularly disposed on the second base and having a second convex component corresponding to the first convex component on an inner side thereof;

a second hollow protruding component disposed above and in communication with the fourth opening; and a third hollow protruding component disposed above and in communication with the second hollow protruding component, wherein the first hole and the second hole of the hollow base are disposed at a top portion of the third hollow protruding component; and wherein the elastic component has one end sleeved with the third hollow protruding component of the hollow base and the other end sleeved with the sleeve.

2. The bottle cover according to claim 1, wherein the top member has a third convex component and a fourth convex component on an inner side thereof, the sleeve has a first concave component corresponding to the fourth convex component at a top portion thereof, the third convex component is sleeved on a periphery of the top portion of the sleeve, and the fourth convex component is engaged with the first concave component.

3. The bottle cover according to claim 2, further comprising a locking component, wherein the fourth convex component includes a locking hole, the first concave component includes a through-hole, and the locking component is configured to pass through the through-hole and be fixed in the locking hole.

4. The bottle cover according to claim 1, further comprising a second sealing component, wherein the sleeve further includes a third stop portion, and the second sealing component is disposed between the second stop portion and the third stop portion.

5. The bottle cover according to claim 1, wherein the sleeve further includes a fourth stop portion, and the first stop portion further includes a recess corresponding to the fourth stop portion.

6. The bottle cover according to claim 1, further comprising a third sealing component disposed among the second base, the third side wall and a lateral wall of the second hollow protruding component.

7. The bottle cover according to claim 1, wherein the bottom member has a fifth convex component on an outside thereof.

8. The bottle cover according to claim 1, wherein the top member has a sixth convex component on an outside thereof.

9. A bottle, comprising:

the bottle cover according to claim 1, wherein the bottom member further has a seventh convex component on an inner side thereof; and a bottle body having an opening and an eighth convex component corresponding to the seventh convex component nearing an exterior margin of the opening, wherein the bottle cover is separately combined with the eighth convex component through the seventh convex component.

10. The bottle cover according to claim 9, further comprising a fourth sealing component having a fourth buckle component and a fourth cover component, wherein the first base further includes a third hole, the fourth buckle component is detachably penetrating and buckled with the third hole, and the fourth cover component is separately covering the third hole.

11. The bottle according to claim 9, further comprising a fifth sealing component, wherein the bottom member further includes a ninth convex component corresponding to the shape of the opening, and is circularly disposed between the first side wall and the second side wall, and the fifth sealing component is disposed between the first side wall and the ninth convex component and is configured to bear against the opening.

12. The bottle according to claim 9, further comprising a protective sleeve sleeved with the bottle body.

13. The bottle according to claim 12, wherein the protective sleeve is made of a cushion material.

* * * * *